US010473364B2

(12) United States Patent
Wang et al.

(10) Patent No.: US 10,473,364 B2
(45) Date of Patent: Nov. 12, 2019

(54) HEAT PUMP SYSTEM AND REGULATING METHOD THEREOF

(71) Applicant: Carrier Corporation, Farmington, CT (US)

(72) Inventors: Weijuan Wang, Shanghai (CN); Haijun Li, Shanghai (CN); Guangyu Shen, Shanghai (CN); Yingzheng Fu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/542,222

(22) PCT Filed: Jan. 7, 2016

(86) PCT No.: PCT/US2016/012424
§ 371 (c)(1),
(2) Date: Jul. 7, 2017

(87) PCT Pub. No.: WO2016/112158
PCT Pub. Date: Jul. 14, 2016

(65) Prior Publication Data

US 2017/0370623 A1 Dec. 28, 2017

(30) Foreign Application Priority Data

Jan. 8, 2015 (CN) ..... 2015 1 0007948

(51) Int. Cl.
*F25B 13/00* (2006.01)
*F25B 6/02* (2006.01)
(Continued)

(52) U.S. Cl.
CPC ..... *F25B 13/00* (2013.01); *F24H 4/02* (2013.01); *F25B 6/02* (2013.01); *F25B 41/003* (2013.01);
(Continued)

(58) Field of Classification Search
CPC ..... F25B 13/00; F25B 41/046; F25B 41/04; F25B 2313/027; F25B 2313/02742;
(Continued)

(56) References Cited

U.S. PATENT DOCUMENTS 3,844,131 A 10/1974 Stillson et al.
4,136,528 A 1/1979 Vogel et al.
(Continued)

FOREIGN PATENT DOCUMENTS

CN 2413238 Y 1/2001
JP H01306776 A 12/1989

OTHER PUBLICATIONS

ISR/WO for application PCT/US2016/012424, dated Apr. 22, 2016, 11 pgs.
(Continued)

*Primary Examiner* — Kun Kai Ma
(74) *Attorney, Agent, or Firm* — Cantor Colburn LLP

(57) ABSTRACT

A heat pump system comprises a compressor, a first heat exchanger, a second heat exchanger, a mode switching valve, a throttling element and a reservoir, wherein the throttling element is arranged on a flow path between the first heat exchanger and the second heat exchanger; and which further comprises a mode switching flow path in which a first flow path and a second flow path are arranged, the reservoir is arranged on the second flow path and each flow path is controllably opened or closed to realize different functional modes.

12 Claims, 2 Drawing Sheets

(51) Int. Cl.

| | |
|---|---|
| ***F25B 41/00*** | (2006.01) |
| ***F25B 41/04*** | (2006.01) |
| ***F24H 4/02*** | (2006.01) |
| ***F25B 43/00*** | (2006.01) |

(52) U.S. Cl.
CPC ..... *F25B 41/04* (2013.01); *F25B 41/046* (2013.01); *F25B 43/006* (2013.01); *F25B 2313/027* (2013.01); *F25B 2313/02742* (2013.01); *F25B 2339/047* (2013.01); *F25B 2400/0415* (2013.01); *F25B 2400/16* (2013.01); *F25B 2400/23* (2013.01); *F25B 2600/2501* (2013.01)

(58) Field of Classification Search
CPC .... F25B 41/46; F25B 41/003; F25B 2400/23; F25B 2339/047; F25B 2400/16
See application file for complete search history.

(56) References Cited

U.S. PATENT DOCUMENTS

| | | | | | |
|---|---|---|---|---|---|
| 4,193,781 | A | | 3/1980 | Powlas et al. | |
| 4,231,229 | A | | 11/1980 | Willitts | |
| 4,437,317 | A | | 3/1984 | Ibrahim | |
| 4,457,138 | A | | 7/1984 | Bowman | |
| 4,535,603 | A | | 8/1985 | Willitts et al. | |
| 4,621,505 | A | | 11/1986 | Ares et al. | |
| 4,735,059 | A | | 4/1988 | O'Neal | |
| 4,831,835 | A | * | 5/1989 | Beehler | F25B 41/04 62/196.1 |
| 5,070,705 | A | | 12/1991 | Goodson et al. | |
| 5,172,559 | A | * | 12/1992 | Renken | B60H 1/00014 62/117 |
| 5,551,249 | A | * | 9/1996 | Van Steenburgh, Jr. | F25B 6/02 62/196.4 |
| 5,673,567 | A | * | 10/1997 | Dube | F25B 6/00 62/117 |
| 10,197,306 | B2 | * | 2/2019 | Li | F25B 13/00 |
| 2008/0022708 | A1 | * | 1/2008 | Cho | F25B 13/00 62/238.7 |
| 2008/0197206 | A1 | * | 8/2008 | Murakami | F25B 13/00 237/2 B |
| 2009/0049857 | A1 | * | 2/2009 | Murakami | F25B 13/00 62/324.6 |
| 2009/0206018 | A1 | * | 8/2009 | Kaneko | B01D 29/114 210/167.32 |
| 2010/0139312 | A1 | * | 6/2010 | Takegami | F25B 13/00 62/498 |
| 2010/0243202 | A1 | * | 9/2010 | Han | F24D 3/18 165/62 |
| 2011/0203299 | A1 | * | 8/2011 | Jing | F25B 13/00 62/80 |
| 2014/0157821 | A1 | | 6/2014 | Schrader et al. | |
| 2015/0338139 | A1 | * | 11/2015 | Xu | F25B 13/00 62/324.6 |
| 2016/0223235 | A1 | * | 8/2016 | Jeong | F25B 47/025 |
| 2017/0010027 | A1 | * | 1/2017 | Liu | F25B 41/04 |

OTHER PUBLICATIONS

Chinese Office Action for applicaiton Cn 201510007948.4, dated May 31, 2019, 7 pages.

* cited by examiner

HEAT PUMP SYSTEM AND REGULATING METHOD THEREOF

FIELD OF THE INVENTION

The present invention relates to the field of air conditioning and sanitary hot water supply equipment, in particular to a heat pump system and a regulating method thereof.

BACKGROUND OF THE INVENTION

At present, in a standard heat pump system or a heat pump system with a heat recovery function, since the amounts of refrigeration medium which is needed to participate in circulation in different functional modes are different, in order to realize higher performance in different functional modes, usually a reservoir is arranged in the system to regulate the amount of the refrigeration medium needed by actual operation. For example, U.S. Pat. No. 5,551,249 discloses a heat pump system with a heat recovery function, the arrangement of which is as shown in FIG. 1, wherein the system is provided with a compressor 10, a heat recovery condenser 34, a condenser 134, an evaporator 100, a reservoir 28 and two bypass valves 52, 58 in the reservoir. The system has various working modes such as refrigeration, heating and hot water production modes, also adopts the reservoir 28 to regulate the refrigeration medium and is a typical heat pump system with a heat recovery function. However, a common technical problem exists in this kind of heat pump systems, i.e., when the heat pump systems operate in a normal refrigeration mode, the refrigeration medium also is stored in the reservoir, directly resulting that quite a few of cooling capacity is attenuated and thereby directly influencing the final refrigerating capacity in the refrigeration mode. However, it is not worth to remove the reservoir for the sake of improvement in the refrigeration mode because this will influence the working performance in the working modes such as heating mode and hot water production mode. Therefore, it is desirable to design a heat pump system which can prevent the refrigeration medium from flowing through the reservoir in the refrigeration mode but can allow the refrigeration medium to normally flow through the reservoir in other modes.

SUMMARY OF THE INVENTION

The present invention aims at providing a heat pump system and a regulating method thereof in order to solve the problem that the cold loss is caused for a reason that it is difficult for the heat pump system in the prior art to prevent the refrigeration medium from flowing through a reservoir in a refrigeration mode.

According to one aspect of the present invention, the present invention provides a heat pump system, which comprises a compressor, a first heat exchanger, a second heat exchanger, a mode switching valve, a throttling element and a reservoir, wherein the throttling element is arranged on a flow path between the first heat exchanger and the second heat exchanger; and the heat pump system further comprises a mode switching flow path, wherein a first flow path and a second flow path are arranged in the mode switching flow path, the reservoir is arranged on the second flow path and each flow path is controllably opened or closed to realize different functional modes, wherein in a refrigeration mode, a refrigeration medium circulating flow direction is from a gas outlet of the compressor to a gas suction port of the compressor through the mode switching valve, the first heat exchanger, the first flow path, the second heat exchanger and the mode switching valve; and/or in a heating mode, the refrigeration medium circulating flow direction is from the gas outlet of the compressor to the gas suction port of the compressor through the mode switching valve, the second heat exchanger, the second flow path, the first heat exchanger and the mode switching valve.

According to another aspect of the present invention, the present invention further provides a heat pump system, which comprises a compressor, a first heat exchanger, a second heat exchanger, a heat recovery heat exchanger, a mode switching valve, a throttling element and a reservoir, wherein the throttling element is arranged on a flow path between any two of the first heat exchanger, the second heat exchanger and the heat recovery heat exchanger; and the heat pump system further comprises a mode switching flow path, wherein a first flow path, a second flow path, a third flow path and a fourth flow path are arranged in the mode switching flow path, the reservoir is arranged on the second flow path and/or the third flow path and/or the fourth flow path and each flow path is controllably opened or closed to realize different functional modes, wherein in a refrigeration mode, a refrigeration medium circulating flow direction is from a gas outlet of the compressor to a gas suction port of the compressor through the mode switching valve, the first heat exchanger, the first flow path, the second heat exchanger and the mode switching valve; and/or in a heating mode, the refrigeration medium circulating flow direction is from the gas outlet of the compressor to the gas suction port of the compressor through the mode switching valve, the second heat exchanger, the second flow path, the first heat exchanger and the mode switching valve; and/or in a refrigeration heat recovery mode, the refrigeration medium circulating flow direction is from the gas outlet of the compressor to the gas suction port of the compressor through the mode switching valve, the heat recovery heat exchanger, the third flow path, the second heat exchanger and the mode switching valve; and/or in a hot water production mode, the refrigeration medium circulating flow direction is from the gas outlet of the compressor to the gas suction port of the compressor through the mode switching valve, the heat recovery heat exchanger, the fourth flow path, the first heat exchanger and the mode switching valve.

Optionally, the second flow path, the third flow path and the fourth flow path are provided with a first common flow path and the reservoir is arranged on the first common flow path.

Optionally, the first flow path, the second flow path, the third flow path and the fourth flow path are provided with a second common flow path and the throttling element is arranged on the second common flow path.

Optionally, at the downstream of the second common flow path, the first flow path, the second flow path, the third flow path and the fourth flow path are respectively provided with solenoid valves for controlling the opening and closing of the first flow path, the second flow path, the third flow path and the fourth flow path.

Optionally, a bypass flow path and a control valve on the bypass flow path are arranged between a flow path between the throttling element and the solenoid valves and an outlet of the reservoir.

Optionally, a fifth flow path is also arranged between the flow path between the throttling element and the solenoid valves and an outlet of the heat recovery heat exchanger, and a defrosting solenoid valve for controlling the opening and closing of the fifth flow path is arranged on the fifth flow path.

Optionally, the mode switching flow path comprises a first three-way port, a second three-way port, a third three-way port, a fourth three-way port and a multi-way port, wherein the first flow path is a flow path from the first three-way port to the third three-way port through the second three-way port, the throttling element and the multi-way port; and/or the second flow path is a flow path from the third three-way port to the first three-way port through the fourth three-way port, the reservoir, the second three-way port, the throttling element and the multi-way port; and/or the third flow path is a flow path from the fourth three-way port to the third three-way port through the reservoir, the second three-way port, the throttling element and the multi-way port; and/or the fourth flow path is a flow path from the fourth three-way port to the first three-way port through the reservoir, the second three-way port, the throttling element and the multi-way port.

Optionally, a first end of the first three-way port is connected with the first heat exchanger, a second end of the first three-way port is connected with a first end of the multi-way port through a first solenoid valve, and a third end of the first three-way port is connected with a first end of the second three-way port through a first one-way valve; a second end of the second three-way port is connected with a second end of the multi-way port through the throttling element, and a third end of the second three-way port is connected with a first end of the fourth three-way port through the reservoir; a first end of the third three-way port is connected with the second heat exchanger, a second end of the third three-way port is connected with a third end of the multi-way port through a second solenoid valve, and a third end of the third three-way port is connected with a third end of the fourth three-way port through a second one-way valve; and a second end of the fourth three-way port is connected with the heat recovery heat exchanger through a third one-way valve.

Optionally, a fourth one-way valve is arranged between the first solenoid valve and the second end of the first three-way port; and/or a fifth one-way valve is arranged between the second solenoid valve and the first end of the third three-way port.

Optionally, the mode switching valve is provided with a first switching position, a second switching position, a third switching position and a fourth switching position; at the first switching position, the mode switching valve respectively communicates the gas outlet of the compressor with the first heat exchanger and the gas suction port of the compressor with the second heat exchanger; and/or at the second switching position, the mode switching valve respectively communicates the gas outlet of the compressor with the second heat exchanger and the gas suction port of the compressor with the first heat exchanger; and/or at the third switching position, the mode switching valve respectively communicates the gas outlet of the compressor with the heat recovery heat exchanger and the gas suction port of the compressor with the second heat exchanger; and/or at the fourth switching position, the mode switching valve respectively communicates the gas outlet of the compressor with the heat recovery heat exchanger and the gas suction port of the compressor with the first heat exchanger.

Optionally, the mode switching valve comprises a first four-way valve and a second four-way valve; the first four-way valve is provided with a port a1, a port b1, a port c1 and a port d1, and the second four-way valve is provided with a port a2, a port b2, a port c2 and a port d2, wherein the port a1 is connected with the gas outlet of the compressor, the port b1 is connected with the heat recovery heat exchanger, the port c1 is connected with the gas suction port of the compressor, the port d1 is connected with the port a2, the port b2 is connected with the first heat exchanger, the port c2 is connected with the gas suction port of the compressor and the port d2 is connected with the second heat exchanger; at the first switching position, the port a1 is communicated with the port d1, the port b1 is communicated with the port c1, the port a2 is communicated with the port b2 and the port c2 is communicated with the port d2; and/or at the second switching position, the port a1 is communicated with the port d1, the port b1 is communicated with the port c1, the port a2 is communicated with the port d2 and the port b2 is communicated with the port c2; and/or at the third switching position, the port a1 is communicated with the port b1, the port c1 is communicated with the port d1, the port a2 is communicated with the port b2 and the port c2 is communicated with the port d2; and/or at the fourth switching position, the port a1 is communicated with the port d1, the port b1 is communicated with the port c1, the port a2 is communicated with the port d2 and the port b2 is communicated with the port c2.

According to another aspect of the present invention, the present invention further provides a method for regulating the foresaid heat pump system, wherein when the heat pump system is switched from the heating mode, the refrigeration heat recovery mode or the hot water production mode to the refrigeration module, the control valve is opened to conduct the bypass flow path and the refrigeration medium remained in the reservoir in the heating mode, the refrigeration heat recovery mode or the hot water production mode is guided back into the first flow path.

In the heat pump system according to the present invention, through the arrangement of the refrigeration flow path, when the system operates in the refrigeration mode, the refrigeration medium can be enabled not to flow through the reservoir such that the cold loss is avoided and the refrigeration efficiency is effectively improved; and at the same time, when the system operates in other functional modes, the refrigeration medium is enabled to flow through the reservoir and partial refrigeration medium is stored in the reservoir according to the needs such that the reliability of the system under other functional modes is guaranteed. Therefore, the working effects of the heat pump system provided by the present invention in all functional modes are effectively improved. In the regulating method of the heat pump system according to the present invention, when the heat pump system is switched from any function mode to the refrigeration mode, the refrigeration medium stored in the reservoir is guided back into the system flow path for circulation in the refrigeration mode, the operating efficiency of the heat pump system in the refrigeration mode is greatly improved and thereby the reliability of the entire heat pump system is improved.

DESCRIPTION OF THE EMBODIMENTS

Figure 1:
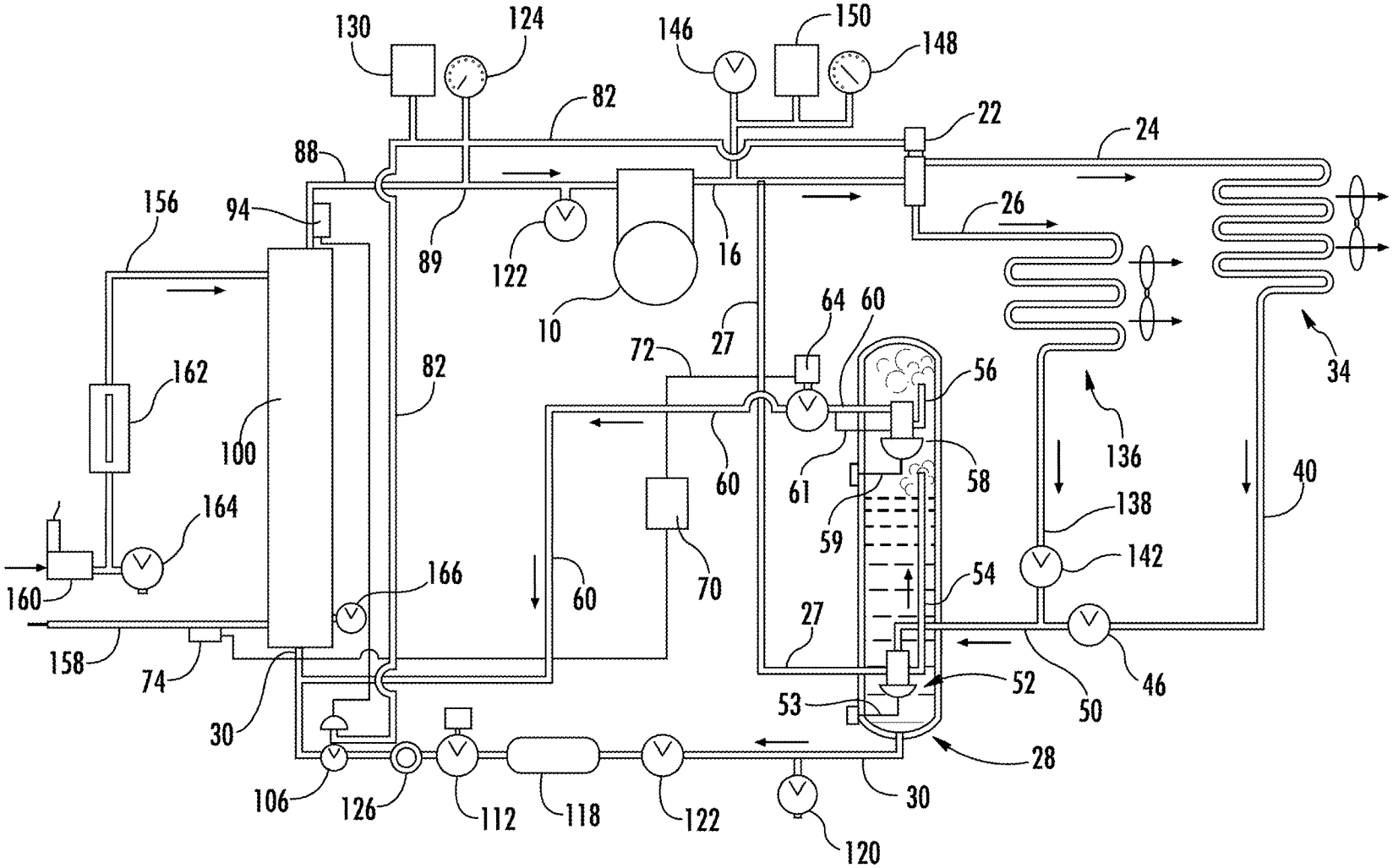
FIG. 1 is a system schematic diagram of a heat pump system in the prior art.
Figure 2:
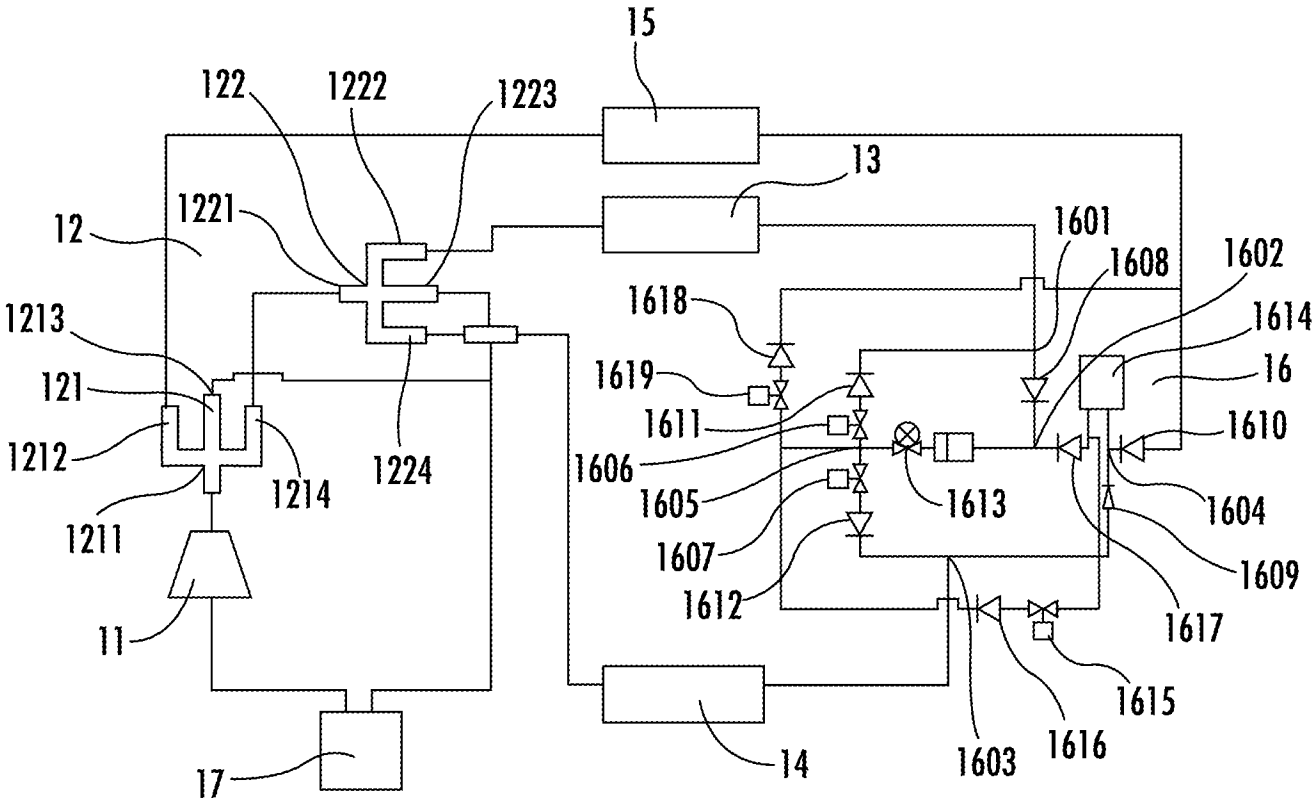
FIG. 2 is a system schematic diagram of one embodiment of a heat pump system provided by the present invention.

As shown in FIG. 2, according to one embodiment of the present invention, a heat pump system is provided, the heat pump system comprises a compressor 11, a mode switching valve 12, a first heat exchanger 13, a second heat exchanger 14, a heat recovery heat exchanger 15, a throttling element 1613 and a mode switching flow path 16.

The mode switching flow path 16 is provided with a first flow path, a second flow path, a third flow path and a fourth flow path with the throttling element 1613 and each flow path is controllably opened or closed to realize different functional modes. In this embodiment, the first flow path, the second flow path, the third flow path and the fourth flow path are provided with a second common flow path and the throttling element 1613 is arranged on the second common flow path. Thereby the effect that the four flow paths share one throttling element 1613 can be realized, the throttling effect is achieved and simultaneously the component cost is greatly reduced. In addition, a reservoir is arranged on the second flow path, the third flow path and the fourth flow path, and the first flow path is not provided with the reservoir, such arrangement enables the refrigeration medium not to flow through the reservoir in a refrigeration mode of the system, prevents the greater cold loss during refrigeration, allows the refrigeration medium to flow through the reservoir in other modes and realizes the temporary storage function of the needed refrigeration medium. In this embodiment, the second flow path, the third flow path and the fourth flow path are provided with a first common flow path, the reservoir 1614 can be arranged on the first common flow path, thereby the effect of storing liquid of a plurality of flow paths by using one reservoir is realized and the component cost is greatly reduced.

By applying the heat pump system in the above-mentioned embodiment, in a refrigeration mode, a refrigeration medium circulating flow direction is from a gas outlet of the compressor 11 to a gas suction port of the compressor 11 through the mode switching valve 12, the first heat exchanger 13, the first flow path of the mode switching flow path 16, the second heat exchanger 14 and the mode switching valve 12; and/or in a heating mode, the refrigeration medium circulating flow direction is from the gas outlet of the compressor 11 to the gas suction port of the compressor 11 through the mode switching valve 12, the second heat exchanger 14, the second flow path of the mode switching flow path 16, the first heat exchanger 13 and the mode switching valve 12; and/or in a refrigeration heat recovery mode, the refrigeration medium circulating flow direction is from the gas outlet of the compressor 11 to the gas suction port of the compressor 11 through the mode switching valve 12, the heat recovery heat exchanger 15, the third flow path of the mode switching flow path 16, the second heat exchanger 14 and the mode switching valve 12; and/or in a hot water production mode, the refrigeration medium circulating flow direction is from the gas outlet of the compressor 11 to the gas suction port of the compressor 11 through the mode switching valve 12, the heat recovery heat exchanger 15, the fourth flow path of the mode switching flow path 16, the first heat exchanger 13 and the mode switching valve 12.

It should be understood that according to the scheme and the principle of the present invention, one skilled in the art can apply the flow path design which bypasses the reservoir in the refrigeration mode to a conventional heat pump system without a heat recovery flow path without contributing any inventive labor. For example, in the embodiment as shown in FIG. 2, the above-mentioned application can be realized by removing the flow path for arranging the heat recovery heat exchanger 15.

The configuration of each part of the heat pump system will be described below in detail.

Firstly the specific composition of the mode switching flow path 16 in the embodiment as shown in FIG. 2 is introduced. The mode switching flow path 16 comprises a first three-way port 1601, a second three-way port 1602, a third three-way port 1603, a fourth three-way port 1604 and a multi-way port 1605. A first end of the first three-way port 1601 is connected with the first heat exchanger 13, a second end of the first three-way port 1601 is connected with a first end of the multi-way port 1605 through a first solenoid valve 1606, and a third end of the first three-way port 1601 is connected with a first end of the second three-way port 1602 through a first one-way valve 1608; a second end of the second three-way port 1602 is connected with a second end of the multi-way port 1605 through the throttling element 1613, and a third end of the second three-way port 1602 is connected with a first end of the fourth three-way port 1604 through the reservoir 1614; a first end of the third three-way port 1603 is connected with the second heat exchanger 14, a second end of the third three-way port 1603 is connected with a third end of the multi-way port 1605 through a second solenoid valve 1607, and a third end of the third three-way port 1603 is connected with a third end of the fourth three-way port 1604 through a second one-way valve 1609; and a second end of the fourth three-way port 1604 is connected with the heat recovery heat exchanger 15 through a third one-way valve 1610.

It should be understood that the flow paths included in the mode switching flow path 16 in the present invention are not certainly flow paths which are fully independent of each other from upstream to downstream. As described above, the flow paths can be provided with the first common flow path and/or the second common flow path. In addition, in consideration of aspects such as cost, space and process of pipe arrangement and system optimization, these flow paths can also be designed to share partial pipes. For example, the specific arrangement of these flow paths in the embodiment as shown in FIG. 2 is as follow: the first flow path is a flow path from the first three-way port 1601 to the third three-way port 1603 through the second three-way port 1602, the throttling element 1613 and the multi-way port 1605; and/or the second flow path is a flow path from the third three-way port 1603 to the first three-way port 1601 through the fourth three-way port 1604, the reservoir 1614, the second three-way port 1602, the throttling element 1613 and the multi-way port 1605; and/or the third flow path is a flow path from the fourth three-way port 1604 to the third three-way port 1603 through the reservoir 1614, the second three-way port 1602, the throttling element 1613 and the multi-way port 1605; and/or the fourth flow path is a flow path from the fourth three-way port 1604 to the first three-way port 1601 through the reservoir 1614, the second three-way port 1602, the throttling element 1613 and the multi-way port 1605.

As described above, in order to guarantee that each flow path can be separately conducted or cut off, an solenoid valve for controlling the opening and closing of each flow path shall be arranged on each flow path. The positions of such solenoid valves are preferably arranged at the downstream of the second common flow path. However, it should be understood that it is not necessary to separately arrange one solenoid valve on each flow path to control the opening and closing thereof, and the effect of controlling the opening and closing of any one of a plurality of flow paths by using one solenoid valve or a plurality of solenoid valves can also be realized through reasonable flow path design and component arrangement. For example, according to the above-mentioned working process, it can be seen that the opening and/or closing of any one of the first flow path, the second flow path, the third flow path and the fourth flow path of the mode switching flow path 16 in the heat pump system provided by the present invention can be realized by controlling the opening and closing of the first solenoid valve 1606 and/or the second solenoid valve 1607.

In addition, the present invention is further provided with a bypass flow path comprising a control valve 1615. This flow path can be connected between a flow path between the throttling element 1613 and the first solenoid valve 1606/second solenoid valve 1607 and the reservoir 1614, i.e., between the fourth end of the multi-way port 1605 and the reservoir 1614, so as to guide the refrigeration medium remained in the reservoir 1614 back into the flow path through pressure difference.

In addition, the present invention is further provided with a fifth flow path comprising a defrosting solenoid valve 1619. This flow path can be connected between a flow path between the throttling element 1613 and the first solenoid valve 1606/second solenoid valve 1607 and an outlet of the heat recovery heat exchanger 15, i.e., between the fourth end of the multi-way port 1605 and the outlet of the heat recovery heat exchanger 15, so as to realize the defrosting of the first heat exchanger 13 by guiding the refrigeration medium in a specific mode to the heat recovery heat exchanger 15 to absorb the heat thereof.

Secondly, the mode switching valve 12 of the heat pump system provided by the present invention is provided with a first switching position, a second switching position, a third switching position and a fourth switching position. At the first switching position, the mode switching valve 12 respectively communicates the gas outlet of the compressor 11 with the first heat exchanger 13 and the gas suction port of the compressor 11 with the second heat exchanger 14; at the second switching position, the mode switching valve 12 respectively communicates the gas outlet of the compressor 11 with the second heat exchanger 14 and the gas suction port of the compressor 11 with the first heat exchanger 13; at the third switching position, the mode switching valve 12 respectively communicates the gas outlet of the compressor 11 with the heat recovery heat exchanger 15 and the gas suction port of the compressor 11 with the second heat exchanger 14; and at the fourth switching position, the mode switching valve 12 respectively communicates the gas outlet of the compressor 11 with the heat recovery heat exchanger 15 and the gas suction port of the compressor 11 with the first heat exchanger 13.

It should be understood that the mode switching valve 12 of the present invention can be a single valve and can also be a combination of a plurality of valves. For examples, it can be a five-way valve or a combination of two four-way valves, as long as the mode switching valve 12 can realize the connection respectively with the gas suction port and the gas outlet of the compressor 11, the first heat exchanger 13, the second heat exchanger 14 and the heat recovery heat exchanger 15 mentioned in this embodiment. The specific connection manners thereof can be various. What is provided in this embodiment is just a preferred solution thereof. However, according to the teaching of the connection manner of the present invention, one skilled in the art can easily make modifications or adjustments to the connection manner of each port of the mode switching valve 12 with components such as the gas suction port and the gas outlet of the compressor 11, the first heat exchanger 13, the second heat exchanger 14 and the heat recovery heat exchanger 15 without contributing any inventive labor. However, such modifications or adjustments shall be included in the protection range of the present invention.

As exemplarily shown in FIG. 2 of the present invention, a preferred connection manner will be described in detail in this disclosure, wherein, the mode switching valve 12 comprises a first four-way valve 121 and a second four-way valve 122, a port a1 1211 of the first four-way valve is connected with the gas outlet of the compressor 11, a port b1 1212 of the first four-way valve is connected with the heat recovery heat exchanger 15, a port c1 1213 of the first four-way valve is connected with the gas suction port of the compressor 11, a port d1 1214 of the first four-way valve is connected with a port a1 1221 of the second four-way valve, a port b1 1222 of the second four-way valve is connected with the first heat exchanger 13, a port c1 1223 of the second four-way valve is connected with the gas suction port of the compressor 11 and a port d1 1224 of the second four-way valve is connected with the second heat exchanger 14. This connection manner specifically gives a flow path which reflects the essence of the present invention.

According to the specific introduction to the mode switching flow path 16 and the mode switching valve 12 provided above and the necessary understanding of one skilled in the art to other conventional refrigeration components, by powering on and off to control the position switching of the mode switching valve 12 and the opening and closing of the first solenoid valve 1606 and the second solenoid valve 1607 in the mode switching flow path 16, the heat pump system can realize four different refrigerant flow circulations and thereby four different air conditioning and/or hot water production working modes can be realized.

Preferably, partial conventional solenoid valves only can guarantee the complete closing of one direction. In order to guarantee the universality of the heat pump system provided by the present invention, a fourth one-way valve 1611, a fifth one-way valve 1612, a sixth one-way valve 1616, a seventh one-way valve 1617 and an eighth one-way valve 1618 can be respectively arranged between the first solenoid valve 1606 and the first three-way port 1601, between the second solenoid valve 1607 and the third three-way port 1603, on the bypass flow path at the downstream of the control valve 1615, between the reservoir 1614 and the second three-way port 1602 and on the fifth flow path at the downstream of the defrosting solenoid valve 1619. Through the cooperation between the one-way valves and the solenoid valves and/or control valve, the control of the opening and closing of the flow paths is thoroughly realized.

Optionally, a gas-liquid separator 17 can also be arranged at the gas suction port of the compressor 11 to prevent liquid refrigerant from entering the compressor 11 and causing a liquid hammer phenomenon.

Optionally, in order to realize the adjustable throttling degree of the throttling element 1613, an electronic expansion valve can be used as the throttling element 1613.

The working process of the heat pump system and the control method of each control valve will be described below with respect to the heat pump system provided by the present invention:

During operation in the refrigeration mode, the first solenoid valve 1606 is powered off, the second solenoid valve 1607 is powered on, the first four-way valve 121 is powered on, the second four-way valve 122 is powered off, high-pressure and high-temperature refrigerant flows out from the gas outlet of the compressor 11, passes through the port a1 1211 of the first four-way valve, the port d1 1214 of the first four-way valve, the port a2 1221 of the second four-way valve and the port b2 1222 of the second four-way valve and flows into the first heat exchanger 13 for heat emission, and then high-pressure and medium-temperature refrigerant flows out, sequentially passes through the first three-way port 1601, the first one-way valve 1608 and the second three-way port 1602 and is throttled by the throttling element 1613 into low-pressure and low-temperature refrigerant, the low-pressure and low-temperature refrigerant passes through the multi-way port 1605, the second solenoid valve 1607, the fifth one-way valve 1612 and the third three-way port 1603 and flows into the second heat exchanger 14 for heat absorption, and then lower-pressure and lower-temperature refrigerant flows out, sequentially passes through the port d2 1224 of the second four-way valve, the port c2 1223 of the second four-way valve and the gas-liquid separator 17 and flows back into the gas suction inlet of the compressor 11, thereby completing the operation in the refrigeration mode.

During operation in the heating mode, the first solenoid valve 1606 is powered on, the second solenoid valve 1607 is powered off, the first four-way valve 121 is powered on, the second four-way valve 122 is powered on, high-pressure and high-temperature refrigerant flows out from the gas outlet of the compressor 11, passes through the port a1 1211 of the first four-way valve, the port d1 1214 of the first four-way valve, the port a2 1221 of the second four-way valve and the port d2 1224 of the second four-way valve and flows into the second heat exchanger 14 for heat emission, and then high-pressure and medium-temperature refrigerant flows out, sequentially passes through the third three-way port 1603, the second one-way valve 1609 and the fourth three-way port 1604, and is partially stored in the reservoir 1614, then passes through the seventh one-way valve 1617, flows to the throttling element 1613 and is throttled by the throttling element 1613 into low-pressure and low-temperature refrigerant, the low-pressure and low-temperature refrigerant passes through the multi-way port 1605, the first solenoid valve 1606 and the first three-way port 1601 and flows into the first heat exchanger 13 for heat absorption, and then lower-pressure and lower-temperature refrigerant flows out, sequentially passes through the port b2 1222 of the second four-way valve, the port c2 1223 of the second four-way valve and the gas-liquid separator 17 and flows back into the gas suction inlet of the compressor 11, thereby completing the operation in the heating mode.

During operation in the refrigeration heat recovery mode, the first solenoid valve 1606 is powered off, the second solenoid valve 1607 is powered on, the first four-way valve 121 is powered off, the second four-way valve 122 is powered off, high-pressure and high-temperature refrigerant flows out from the gas outlet of the compressor 11, passes through the port a1 1211 of the first four-way valve and the port b1 1212 of the first four-way valve and flows into the heat recovery heat exchanger 15 for heat emission, and then high-pressure and medium-temperature refrigerant flows out, sequentially passes through the third one-way valve 1610 and the fourth three-way port 1604, and is partially stored in the reservoir 1614, then passes through the seventh one-way valve 1617, flows to the throttling element 1613 and is throttled by the throttling element 1613 into low-pressure and low-temperature refrigerant, the low-pressure and low-temperature refrigerant passes through the multi-way port 1605, the second solenoid valve 1607 and the third three-way port 1603 and flows into the second heat exchanger 14 for heat absorption, and then lower-pressure and lower-temperature refrigerant flows out, sequentially passes through the port d2 1224 of the second four-way valve, the port c2 1223 of the second four-way valve and the gas-liquid separator 17 and flows back into the gas suction inlet of the compressor 11, thereby completing the operation in the refrigeration heat recovery mode.

During operation in the hot water production mode, the first solenoid valve 1606 is powered on, the second solenoid valve 1607 is powered off, the first four-way valve 121 is powered off, the second four-way valve 122 is powered on, high-pressure and high-temperature refrigerant flows out from the gas outlet of the compressor 11, passes through the port a1 1211 of the first four-way valve and the port b1 1212 of the first four-way valve, flows into the heat recovery heat exchanger 15 for heat emission, and sequentially passes through the third one-way valve 1610 and the fourth three-way port 1604, and is partially stored in the reservoir 1614, passes through the seventh one-way valve 1617, flows to the throttling element 1613 and is throttled by the throttling element 1613 into low-pressure and low-temperature refrigerant, the low-pressure and low-temperature refrigerant passes through the multi-way port 1605, the first solenoid valve 1606 and the first three-way port 1601 and flows into the first heat exchanger 13 for heat absorption, and then lower-pressure and lower-temperature refrigerant flows out, sequentially passes through the port b2 1222 of the second four-way valve, the port c2 1223 of the second four-way valve and the gas-liquid separator 17 and flows back into the gas suction inlet of the compressor 11, thereby completing the operation in the hot water production mode.

During operation of the heating and heat recovery modes, the second solenoid valve 1607 is cut off, the first solenoid valve 1606 is communicated, firstly the first four-way valve 121 and the second four-way valve 122 are supplied with power according to powered on/off states of one mode of the heating mode or the hot water production mode, thereby the heat pump system firstly operates according to one mode of the heating mode or the hot water production mode, upon the conditions set by a user are satisfied, the first four-way valve 121 and the second four-way valve 122 are supplied with power according to powered on/off states of the other mode of the heating mode or the hot water production mode, and thereby the heat pump system operates according to the other mode of the heating mode or the hot water production mode.

When the heat pump system is switched from the heating mode, the refrigeration heat recovery mode or the hot water production mode to the refrigeration mode, the control valve 1615 is opened to conduct the bypass flow path. At this moment, the refrigeration medium remained in the reservoir 1614 in other working modes passes through the control valve 1615 and the sixth one-way valve 1616, flows into the flow path at the downstream of the throttling element 1613, and together with other refrigeration medium participates in the working circulation in the refrigeration mode.

When a defrosting mode is operated due to the needs of equipment, the defrosting solenoid valve 1619 is opened to conduct the fifth flow path. At this moment, the refrigeration medium passes through the defrosting solenoid valve 1619 and the eighth one-way valve 1618 and flows back into the heat recovery heat exchanger 15 to absorb the heat thereof, thereby achieving the effect of defrosting the first heat exchanger 13.

The specific embodiments of the present invention are described above in detail according to the drawings. One skilled in the art can make equivalent modifications or variations to the specific features in the embodiments according to the above-mentioned description. Undoubtedly, all such modified embodiments shall also fall within the protection range covered by the claims.

The invention claimed is:

1. A heat pump system, wherein the heat pump system comprises a compressor, a first heat exchanger, a second heat exchanger, a heat recovery heat exchanger, a mode switching valve, a throttling element and a reservoir, wherein the throttling element is arranged on a flow path between any two of the first heat exchanger, the second heat exchanger and the heat recovery heat exchanger; and the heat pump system further comprises:

a mode switching flow path, wherein a first flow path, a second flow path, a third flow path and a fourth flow path are arranged in the mode switching flow path, the reservoir is arranged on the second flow path and/or the third flow path and/or the fourth flow path and each of the first flow path, the second flow path, the third flow path and the fourth flow path is controllably opened or closed to realize different functional modes, wherein, in a refrigeration mode, a refrigeration medium circulating flow direction is from a gas outlet of the compressor to a gas suction port of the compressor through the mode switching valve, the first heat exchanger, the first flow path, the second heat exchanger and the mode switching valve; and in a heating mode, the refrigeration medium circulating flow direction is from the gas outlet of the compressor to the gas suction port of the compressor through the mode switching valve, the second heat exchanger, the second flow path, the first heat exchanger and the mode switching valve; and in a refrigeration heat recovery mode, the refrigeration medium circulating flow direction is from the gas outlet of the compressor to the gas suction port of the compressor through the mode switching valve, the heat recovery heat exchanger, the third flow path, the second heat exchanger and the mode switching valve; and in a hot water production mode, the refrigeration medium circulating flow direction is from the gas outlet of the compressor to the gas suction port of the compressor through the mode switching valve, the heat recovery heat exchanger, the fourth flow path, the first heat exchanger and the mode switching valve.

2. The heat pump system according to claim 1, wherein: the second flow path, the third flow path and the fourth flow path are provided with a first common flow path and the reservoir is arranged on the first common flow path.

3. The heat pump system according to claim 1, wherein: the first flow path, the second flow path, the third flow path and the fourth flow path are provided with a second common flow path and the throttling element is arranged on the second common flow path.

4. The heat pump system according to claim 1, wherein: the mode switching flow path comprises a first three-way port, a second three-way port, a third three-way port, a fourth three-way port and a multi-way port, wherein, the first flow path is a flow path from the first three-way port to the third three-way port through the second three-way port, the throttling element and the multi-way port; and/or the second flow path is a flow path from the third three-way port to the first three-way port through the fourth three-way port, the reservoir, the second three-way port, the throttling element and the multi-way port; and/or the third flow path is a flow path from the fourth three-way port to the third three-way port through the reservoir, the second three-way port, the throttling element and the multi-way port; and/or the fourth flow path is a flow path from the fourth three-way port to the first three-way port through the reservoir, the second three-way port, the throttling element and the multi-way port.

5. The heat pump system according to claim 1, wherein: the mode switching valve is provided with a first switching position, a second switching position, a third switching position and a fourth switching position;

at the first switching position, the mode switching valve respectively communicates the gas outlet of the compressor with the first heat exchanger and the gas suction port of the compressor with the second heat exchanger; and/or at the second switching position, the mode switching valve respectively communicates the gas outlet of the compressor with the second heat exchanger and the gas suction port of the compressor with the first heat exchanger; and/or at the third switching position, the mode switching valve respectively communicates the gas outlet of the compressor with the heat recovery heat exchanger and the gas suction port of the compressor with the second heat exchanger; and/or at the fourth switching position, the mode switching valve respectively communicates the gas outlet of the compressor with the heat recovery heat exchanger and the gas suction port of the compressor with the first heat exchanger.

6. The heat pump system according to claim 5, wherein: the mode switching valve comprises a first four-way valve and a second four-way valve; the first four-way valve is provided with a port a1, a port b1, a port c1 and a port d1, and the second four-way valve is provided with a port a2, a port b2, a port c2 and a port d2, wherein the port a1 is connected with the gas outlet of the compressor, the port b1 is connected with the heat recovery heat exchanger, the port c1 is connected with the gas suction port of the compressor, the port d1 is connected with the port a2, the port b2 is connected with the first heat exchanger, the port c2 is connected with the gas suction port of the compressor and the port d2 is connected with the second heat exchanger;

at the first switching position, the portal is communicated with the port d1, the port b1 is communicated with the port c1, the port a2 is communicated with the port b2 and the port c2 is communicated with the port d2; and/or at the second switching position, the port a1 is communicated with the port d1, the port b1 is communicated with the port c1, the port a2 is communicated with the port d2 and the port b2 is communicated with the port c2; and/or at the third switching position, the portal is communicated with the port b1, the port c1 is communicated with the port d1, the port a2 is communicated with the port b2 and the port c2 is communicated with the port d2; and/or at the fourth switching position, the portal is communicated with the port d1, the port b1 is communicated with the port c1, the port a2 is communicated with the port d2 and the port b2 is communicated with the port c2.

7. A heat pump system, wherein the heat pump system comprises a compressor, a first heat exchanger, a second heat exchanger, a heat recovery heat exchanger, a mode switching valve, a throttling element and a reservoir, wherein the throttling element is arranged on a flow path between any two of the first heat exchanger, the second heat exchanger and the heat recovery heat exchanger; and the heat pump system further comprises:

a mode switching flow path, wherein a first flow path, a second flow path, a third flow path and a fourth flow path are arranged in the mode switching flow path, the reservoir is arranged on the second flow path and/or the third flow path and/or the fourth flow path and each of the first flow path, the second flow path, the third flow path and the fourth flow path is controllably opened or closed to realize different functional modes, wherein, in a refrigeration mode, a refrigeration medium circulating flow direction is from a gas outlet of the compressor to a gas suction port of the compressor through the mode switching valve, the first heat exchanger, the first flow path, the second heat exchanger and the mode switching valve; and/or in a heating mode, the refrigeration medium circulating flow direction is from the gas outlet of the compressor to the gas suction port of the compressor through the mode switching valve, the second heat exchanger, the second flow path, the first heat exchanger and the mode switching valve; and/or in a refrigeration heat recovery mode, the refrigeration medium circulating flow direction is from the gas outlet of the compressor to the gas suction port of the compressor through the mode switching valve, the heat recovery heat exchanger, the third flow path, the second heat exchanger and the mode switching valve; and/or in a hot water production mode, the refrigeration medium circulating flow direction is from the gas outlet of the compressor to the gas suction port of the compressor through the mode switching valve, the heat recovery heat exchanger, the fourth flow path, the first heat exchanger and the mode switching valve;

wherein the first flow path, the second flow path, the third flow path and the fourth flow path are provided with a second common flow path and the throttling element is arranged on the second common flow path;

wherein at the downstream of the second common flow path, the first flow path, the second flow path, the third flow path and the fourth flow path are respectively provided with solenoid valves for controlling the opening and closing of the first flow path, the second flow path, the third flow path and the fourth flow path.

8. The heat pump system according to claim 7, wherein: a bypass flow path and a control valve on the bypass flow path are arranged between a flow path between the throttling element and the solenoid valves and an outlet of the reservoir.

9. The heat pump system according to claim 8, wherein: a fifth flow path is arranged between the flow path between the throttling element and the solenoid valves and an outlet of the heat recovery heat exchanger, and a defrosting solenoid valve for controlling the opening and closing of the fifth flow path is arranged on the fifth flow path.

10. A method for regulating the heat pump system according to claim 8, wherein:

when the heat pump system is switched from the heating mode, the refrigeration heat recovery mode or the hot water production mode to the refrigeration mode, the control valve is opened to conduct the bypass flow path and the refrigeration medium remained in the reservoir in the heating mode, the refrigeration heat recovery mode or the hot water production mode is guided back into the first flow path.

11. A heat pump system, wherein the heat pump system comprises a compressor, a first heat exchanger, a second heat exchanger, a heat recovery heat exchanger, a mode switching valve, a throttling element and a reservoir, wherein the throttling element is arranged on a flow path between any two of the first heat exchanger, the second heat exchanger and the heat recovery heat exchanger; and the heat pump system further comprises:

a mode switching flow path, wherein a first flow path, a second flow path, a third flow path and a fourth flow path are arranged in the mode switching flow path, the reservoir is arranged on the second flow path and/or the third flow path and/or the fourth flow path and each of the first flow path, the second flow path, the third flow path and the fourth flow path is controllably opened or closed to realize different functional modes, wherein, in a refrigeration mode, a refrigeration medium circulating flow direction is from a gas outlet of the compressor to a gas suction port of the compressor through the mode switching valve, the first heat exchanger, the first flow path, the second heat exchanger and the mode switching valve; and/or in a heating mode, the refrigeration medium circulating flow direction is from the gas outlet of the compressor to the gas suction port of the compressor through the mode switching valve, the second heat exchanger, the second flow path, the first heat exchanger and the mode switching valve; and/or in a refrigeration heat recovery mode, the refrigeration medium circulating flow direction is from the gas outlet of the compressor to the gas suction port of the compressor through the mode switching valve, the heat recovery heat exchanger, the third flow path, the second heat exchanger and the mode switching valve; and/or in a hot water production mode, the refrigeration medium circulating flow direction is from the gas outlet of the compressor to the gas suction port of the compressor through the mode switching valve, the heat recovery heat exchanger, the fourth flow path, the first heat exchanger and the mode switching valve;

the mode switching flow path comprises a first three-way port, a second three-way port, a third three-way port, a fourth three-way port and a multi-way port, wherein, the first flow path is a flow path from the first three-way port to the third three-way port through the second three-way port, the throttling element and the multi-way port; and/or the second flow path is a flow path from the third three-way port to the first three-way port through the fourth three-way port, the reservoir, the second three-way port, the throttling element and the multi-way port; and/or the third flow path is a flow path from the fourth three-way port to the third three-way port through the reservoir, the second three-way port, the throttling element and the multi-way port; and/or the fourth flow path is a flow path from the fourth three-way port to the first three-way port through the reservoir, the second three-way port, the throttling element and the multi-way port;

a first end of the first three-way port is connected with the first heat exchanger, a second end of the first three-way port is connected with a first end of the multi-way port through a first solenoid valve, and a third end of the first three-way port is connected with a first end of the second three-way port through a first one-way valve; a second end of the second three-way port is connected with a second end of the multi-way port through the throttling element, and a third end of the second three-way port is connected with a first end of the fourth three-way port through the reservoir; a first end of the third three-way port is connected with the second heat exchanger, a second end of the third three-way port is connected with a third end of the multi-way port through a second solenoid valve, and a third end of the third three-way port is connected with a third end of the fourth three-way port through a second one-way valve; and a second end of the fourth three-way port is connected with the heat recovery heat exchanger through a third one-way valve.

12. The heat pump system according to claim 11, wherein a fourth one-way valve is arranged between the first solenoid valve and the second end of the first three-way port; and/or a fifth one-way valve is arranged between the second solenoid valve and the first end of the third three-way port.

* * * * *